US007663296B2

(12) United States Patent
Kunitomo et al.

(10) Patent No.: US 7,663,296 B2
(45) Date of Patent: Feb. 16, 2010

(54) SPARK PLUG FOR INTERNAL COMBUSTION ENGINE

(75) Inventors: Iwao Kunitomo, Nagoya (JP); Yoshihiro Matsubara, Yokkaichi (JP); Hironobu Mizutani, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 363 days.

(21) Appl. No.: 11/730,172

(22) Filed: Mar. 29, 2007

(65) Prior Publication Data

US 2007/0228916 A1 Oct. 4, 2007

(30) Foreign Application Priority Data

Mar. 29, 2006 (JP) ..... P2006-091468

(51) Int. Cl.
*H01T 13/20* (2006.01)

(52) U.S. Cl. ..... 313/141; 313/143

(58) Field of Classification Search ..... 313/141, 313/143

See application file for complete search history.

(56) References Cited

U.S. PATENT DOCUMENTS 7,145,287 B2 * 12/2006 Kato ..... 313/141

2006/0163992 A1 * 7/2006 Kanao et al. ..... 313/141

* cited by examiner

*Primary Examiner*—Vip Patel
(74) *Attorney, Agent, or Firm*—Sughrue Mion, PLLC

(57) ABSTRACT

A spark plug including: a cylindrical insulator having an axial hole extending through the insulator in an axial direction; a center electrode inserted in the axial hole; a metal shell provided around an outer periphery of the insulator and having a leading end surface, from which a leading end surface of the insulator protrudes; a ground electrode having a base end bonded to the leading end surface of the metal shell; and a noble metal tip disposed on a distal end of the ground electrode, an end of the noble metal tip protruding toward the center electrode in a radial direction, wherein: the spark plug forming a spark discharge path upon application of a discharging voltage between the protruding end of the noble metal tip and an end of the center electrode, the spark discharge path including an aerial discharge gap between a part of the protruding end of the noble metal tip and a part of the end of the insulator and a surface-creeping discharge path beginning at a part of the end of the insulator and a part of the center electrode and extending along the end surface of the insulator; and the noble metal tip protruding from the leading end of the ground electrode by a protruding length of more than 0.2 mm.

12 Claims, 8 Drawing Sheets

SPARK PLUG FOR INTERNAL COMBUSTION ENGINE

BACKGROUND OF THE INVENTION

1. Field of the Invention

The present invention relates to a spark plug for use in an internal combustion engine and, more particularly, to a spark plug for an internal combustion engine having a semi-surface discharge gap.

2. Description of the Related Art

Semi-surface discharge type spark plugs have been known as spark plugs for internal combustion engines having improved anti-fouling properties. Such a semi-surface discharge type spark plug (hereinafter also referred to as a semi-surface spark plug) is similar to a normal aerial discharge type spark plug in that it includes a center electrode, an insulator provided around the outer periphery of the electrode, a cylindrical metal shell provided around the outer periphery of the insulators and a ground electrode having a base end bonded to the leading end of the metal shell. The semi-surface spark plug is configured such that application of a voltage between the center electrode and the ground electrode forms a spark discharge path (spark discharge gap). The spark discharge path is constituted by an aerial discharge gap between a part of a leading end of the ground electrode and a part of a leading end of the insulator and a surface-creeping discharge path beginning at a part of the leading end of the insulator and a part of a region of the center electrode in the vicinity of the leading end surface of the insulator.

It is known that when a spark plug is operated over a prolonged period of time in a low temperature environment, the spark plug enters what is called a "smoldered" or "covered" state in which a leading end surface of the insulator is covered by a conductive fouling substance such as carbon. This results in a state called "fouling" that disables proper firing at the spark discharge gap. In this regard, a semi-surface spark plug as described above has improved anti-fouling properties as compared to an aerial discharge type spark plug. This is because fouling substances are burned off by spark discharge which takes place along the leading end surface of the insulator (for example, see JP-A-2003-22885).

3. Problems to be Solved by the Invention

The durability of a spark plug must be maintained by extracting sufficient heat from the ground electrode. In order to maintain the durability of the ground electrode at a predetermined level, a somewhat large size ground electrode is used in practice.

However, when attempting to satisfy the demand simply by using a large-sized ground electrode, a space for allowing the flame kernel to spread can be obstructed. Also, the beat of the flame is likely to be removed by the ground electrode, which can worsen the quenching effect. As a result, the ignition capability may be reduced.

Compared to an aerial discharge type spark plug, a semi-surface spark plug tends to exhibit a higher possibility of fuel bridging. This is because the ground electrode in such a structure necessarily faces the insulator over a large area. When the size of the ground electrode is further increased as described above, the risk of fuel bridging further increases.

JP-A-2003-22885 discloses a noble metal tip provided on a ground electrode. However, a reduction in ignition capability and the risk of fuel bridging still remains when the countermeasure is to simply provide a tip, although a certain level of durability can be achieved.

SUMMARY OF THE INVENTION

The invention was made taking the above-described factors into consideration, and it is an object of the invention to provide a semi-surface discharge type spark plug for an internal combustion engine having improved ignition capability and a low possibility of fuel bridging, while also achieving sufficient durability and anti-fouling properties.

The above object of the invention has been achieved by providing, in accordance with a first embodiment (1), a spark plug for an internal combustion engine having a leading side and a base side, said spark plug characterized in that it includes a cylindrical insulator having an axial hole extending through the insulator in an axial direction, a center electrode inserted in the axial hole, a metal shell provided around the outer periphery of the insulator and having a leading end surface from which a leading end surface of the insulator protrudes, one or more ground electrodes having a base end bonded to the leading end surface of the metal shell, and a noble metal tip having a first end disposed (or secured) on a distal end of the one or more ground electrodes, a second end of the metal tip protruding toward the center electrode in a radial direction, wherein:

said spark plug forming a spark discharge path upon application of a discharging voltage between the second end of the noble metal tip and an end of the center electrode, said spark discharge path comprising an aerial discharge gap between a part of the second end of the noble metal tip and a part of the end of the insulator and a surface-creeping discharge path beginning at a part of the end of the insulator and a part of the center electrode and extending along the end surface of the insulator; and said noble metal tip protruding from the distal end of the ground electrode by a protruding length of more than 0.2 mm.

As described in (1) above, the spark plug has a leading side and a base side. The base end (proximal end) of the ground electrode is bonded to the leading end surface of the metal shell. A first end of the noble metal tip is disposed on a distal end of the ground electrode, so that the second (opposing) end of the noble metal tip protrudes toward the center electrode in a radial direction. The ground electrode can generally have a parallelpiped shape. The noble metal tip may be disposed on a tip end surface of the ground electrode 4A as shown in FIG. 2B when the distal end of the ground electrode is inwardly bent towards the center electrode 3. In another configuration, for example, the noble metal tip may be disposed on an inner side surface of the distal end of the ground electrode as shown in FIG. 9C (when the ground electrode is not bent). See also FIG. 10C. The second end of the noble metal tip protrudes in the radial direction toward the center electrode, and an alloy primarily composed of a noble metal such as platinum or iridium may be used as the tip material. When the tip end surface of the ground electrode faces the center electrode in the radial direction and the noble metal tip protrudes from the tip end surface of the ground electrode, the protruding surface of the noble metal tip preferably has a surface area that is smaller than that of the tip end surface of the ground electrode and a thickness that is smaller than that of the tip end of the ground electrode.

In embodiment (1), since the noble metal tip having a second end protruding toward the center electrode in a radial direction is disposed or bonded on a distal end of the ground electrode, spark discharge occurs between the noble metal tip and the center electrode. Since the noble metal tip has high oxidation resistance at high temperatures and high wear resistance, the tip itself and the ground electrode are less susceptible to wear, and sufficient durability can be achieved in this sense. Since the spark discharge path includes the surface-creeping discharge path extending along the leading end surface of the insulator as part of the same, spark discharge takes place so as to creep over the leading end surface of the insulator. As a result, fouling substances are burned off to provide anti-fouling properties. Further, durability can be achieved without substantially increasing the size of the ground electrode. There is no need to increase the electrode size. Accordingly, obstruction of space for allowing spread of the flame kernel is suppressed, and the heat of flame is less likely to be removed. It is therefore possible to suppress a reduction in ignition capability.

In embodiment (1), the noble metal tip has a protruding length of longer than 0.2 mm from the distal end of the ground electrode. Referring to the space in the vicinity of the igniting point, the position of the distal end of the ground electrode (the body of the electrode) is further from the igniting point compared to the position of an electrode without the noble metal chip. That is, the noble metal tip having a smaller sectional area is present in the vicinity of the igniting point. Since space for combustion can be more easily accommodated as thus described, it is expected that the flame kernel will spread more smoothly, and a further reduction can be achieved in the degree to which the heat of the flame is removed by the ground electrode. As a result, ignition capability can be further improved. When the protruding length is 0.2 mm or less, the above-described effects associated with improving ignition capability may not be sufficiently achieved.

The region in which spark discharge can take place is considered next. The total area of the surface of the protruding end of the noble metal tip and the end surface of the insulator facing the protruding end can be smaller than the total area of the tip end surface of a ground electrode without the noble metal chip and another surface facing the same. It is therefore possible to reduce opportunities in which insufficiently atomized fuel collects between the leading end of the insulator and the ground electrode (noble metal tip), which consequently allows fuel bridging to be suppressed.

In addition, since the noble metal tip is configured to protrude, the length of the ground electrode can accordingly be made small. Therefore, a heat-receiving area of the ground electrode will be small, which allows the thermal load on the electrode to be reduced. Furthermore, since a reduction can be achieved in the weight of the ground electrode (the body of the electrode), it is possible to suppress vibration of the electrode and to provide the electrode with improved breakage resistance.

It is not necessarily advantageous to set the protruding length at an arbitrarily large value. That is, it is more desirable to employ embodiment (2) described below.

In a preferred embodiment (2), the spark plug according to the present invention is characterized in that the noble metal tip in (1) above has a protruding length of 5 mm or less from the distal end of the ground electrode.

In general, the material cost of the noble metal tip increases as the protruding length increases. In this regard, the effect of improving ignition capability increases less significantly relative to an increase in manufacturing cost when the protruding length of the noble metal tip from the distal end of the ground electrode exceeds 5 mm. It is therefore more desirable to employ embodiment (2).

In yet a preferred embodiment (3), the spark plug according to the present invention is characterized in that the noble metal tip in (1) or (2) above has a thickness of 1.0 mm or less.

Specifically, the term "thickness" means the axial distance between an end-side edge of the protruding end surface of the noble metal tip that is an end-side extremity of the protruding end surface when viewed in the axial direction and a base end-side edge of the protruding end surface of the noble metal tip that is a base end-side extremity of the protruding end surface when viewed in the axial direction, in a plane including the above-mentioned axis and an axis of the noble metal chip in the protruding direction of the noble metal tip. Therefore, when a noble metal tip having, for example, a rectangular parallelepiped shape is disposed to extend in the radial direction orthogonal to the axial direction, the term means the thickness of the tip in an arbitrary position in the axial direction. When the noble metal tip protrudes so as to intersect with the axial direction in a non-orthogonal manner (or at an angle to the axial direction), the length of the protruding end of the noble metal tip in the axial direction constitutes the thickness of the tip.

In (3) above, since the noble metal tip has a thickness of 1.0 mm or less, the effect of allowing an improvement in ignition capability can be more reliably achieved. In particular, when consideration is paid to the fact that the position of spark discharge varies within the thickness of the noble metal chip, the position of spark discharge can vary only within the range of the thickness as described above. As a result, variations of the position of spark discharge can be suppressed to maintain stable combustion by setting the thickness as small as 1.0 mm or less. On the contrary, when the thickness of the noble metal tip is more than 1.0 mm, the position of spark discharge is more likely to vary, which can hinder stable combustion and can affect ignition capability.

It is not necessarily advantageous to reduce the thickness of the noble metal tip to an extreme. It is more desirable to employ embodiment (4) described below.

In accordance with a preferred embodiment (4), the spark plug according to the present invention is characterized in that the noble metal tip has a thickness of 0.2 mm or more.

In general, when the thickness of the noble metal tip is too small, the tip has a small thermal capacity because of its small volume. As a result, the noble metal tip is always in a high temperature (overheated) state during use, and its anti-wear properties deteriorate. Therefore, the tip preferably has a thickness of 0.2 mm or more as in (4) above.

In yet another preferred embodiment (5), the spark plug according to the present invention is characterized in that the noble metal tip in any of (1) to (4) above has a width which is 50% or more of the diameter of the axial hole at the end surface of the insulator.

Specifically, the term "width" means the distance between both edges of the protruding end surface of the noble metal tip in a direction orthogonal to the radial direction and orthogonal to the axial direction (the distance between left and right edges of the tip) when the ground electrode having the noble metal tip provided thereon is viewed in the radial direction from the center electrode.

In (5) above, since the width of the noble metal tip is 50% or more of the diameter of the axial hole at the end surface of the insulator, sparks fly in a wide range toward the center electrode from the circumferential direction thereof, which allows fouling substances on the leading end surface of the insulator around the center electrode to be reliably burned off. As a result, anti-fouling properties can be further improved.

In yet another preferred embodiment (6), the spark plug according to the present invention is characterized in that the noble metal tip in (5) above has a width equal to or smaller than the outer diameter of the end surface of the insulator.

Since the width of the noble metal tip depends on a range to be cleaned on the leading end surface of the insulator, the noble metal tip can exhibit the maximum of its capability when it has a width equal to the outer diameter of the end surface of the insulator which can be fouled. Therefore, the width of the tip may be equal to or smaller than the outer diameter of the end surface of the insulator. A sufficient cleaning capability can be achieved in the direction toward the ground electrode at which spark discharge takes place even when the tip width is about the same as the diameter of the axial hole at the end surface of the insulator. Therefore, the width is preferably equal to or smaller than the axial hole diameter at the end surface of the insulator when the amount of the noble metal to be used and ignition capability is taken into consideration.

In yet another preferred embodiment (7), the spark plug according to the present invention is characterized in that, in any of (1) to (6) above, an end-side edge of the protruding end surface of the noble metal tip, when viewed in the axial direction, is displaced from the leading end surface of the insulator toward the leading side of the spark plug and in that an opposing end-side edge of the protruding end surface of the noble metal tip, when viewed in the axial direction, is displaced from the leading end surface of the insulator toward the base side of the spark plug.

In (7) above, an end-side edge of the protruding end surface of the noble metal tip, which is an end-side extremity of the protruding end surface when viewed in the axial direction, is displaced from the leading end surface of the insulator toward the leading side of the spark plug, and an opposing end-side edge of the protruding end surface of the noble metal tip, which is an end-side extremity of the protruding end surface when viewed in the axial direction, is displaced from the leading end surface of the insulator toward the base side of the spark plug. That is, the protruding end surface of the noble metal tip and the leading end surface of the insulator are located substantially at the same height. Therefore, spark discharge along the leading end surface of the insulator can be easily maintained. It is therefore possible to prevent a problem known as channeling attributable to wear of the insulator while maintaining the desired anti-fouling properties. When the end-side edge of the protruding end surface of the noble metal tip, which is an end-side extremity of the protruding end surface when viewed in the axial direction, is displaced from the leading end surface of the insulator toward the base side rather than the leading side, sparks are more likely to impinge on a side surface of the insulator, which results in wear of the insulator and can lead to channeling. When the base end-side edge of the protruding end surface of the noble metal tip, which is a base end-side extremity of the protruding end surface when viewed in the axial direction, is displaced from the leading end surface of the insulator toward the leading side of the spark plug, spark discharge along the leading end surface of the insulator is unlikely to occur, which can result in a reduction in anti-fouling properties.

The following configuration (8) is desirably employed to allow the above-described effects to be more reliably achieved.

That is, in a preferred embodiment (8), the spark plug according to the present invention in any of (1) to (7) above is characterized as comprising a plurality of ground electrodes having disposed thereon the noble metal tip of (1) above.

The following configuration (9) may alternatively be employed.

That is, in a preferred embodiment (9), the spark plug according to the present invention is characterized as further comprising a parallel ground electrode facing an end surface of the center electrode at one side surface thereof and forming an aerial discharge gap extending in the axial direction, in addition to any of (1) to (8) described above.

Such spark plugs are generally referred to as multi-electrode semi-surface plugs or hybrid plugs, and the above-described configurations of the noble metal tip may be employed in forming such spark plugs.

Further, the following configurations solve recent problems which have not yet been encountered in the related art.

Thus, in a preferred embodiment (10), the spark plug according to the present invention is characterized in that a thread on the outer periphery of the metal shell in any of (1) to (9) above has a diameter of M10 or less.

In forming a semi-surface discharge type spark plug, when the thread diameter of the outer periphery of the metal shell is made as small as M10 or less, practical difficulties are encountered in the related art in bending the distal end of the ground electrode along the leading end surface of the insulator for reasons associated with space. On the contrary, when a protruding noble metal tip as described above is used, semi-surface discharge can be realized without difficulty even in the case of a spark plug having a thread diameter as small as M10 or less on the outer periphery of the metal shell.

In a general situation wherein a side surface at an end portion of an insulator continues to the end surface of the same so as to define a predetermined radius of curvature, it is desirable to employ the following configuration.

Thus, in yet another preferred embodiment (11), the spark plug according to the present invention is characterized in that in any of (1) to (10) above, a side surface at an end portion of the insulator continues to the end surface of the insulator so as to define a radius of curvature $R \geqq 0.2$ mm, which radius of curvature R and a thickness t1 of the noble metal tip satisfy a relationship expressed by:

$$t1(\mathrm{mm}) \times R(\mathrm{mm}) \leqq 1$$

The position of spark discharge may vary when the radius of curvature R is too large. Further, the position of spark discharge tends to vary similarly when the tip thickness t1 is too large. Therefore, in order to advantageously achieve the effects of the above-described configurations, it is more preferable to set the radius of curvature R and the tip thickness t1 such that the above relationship is satisfied.

DESCRIPTION OF REFERENCE NUMERALS

Figure 1:
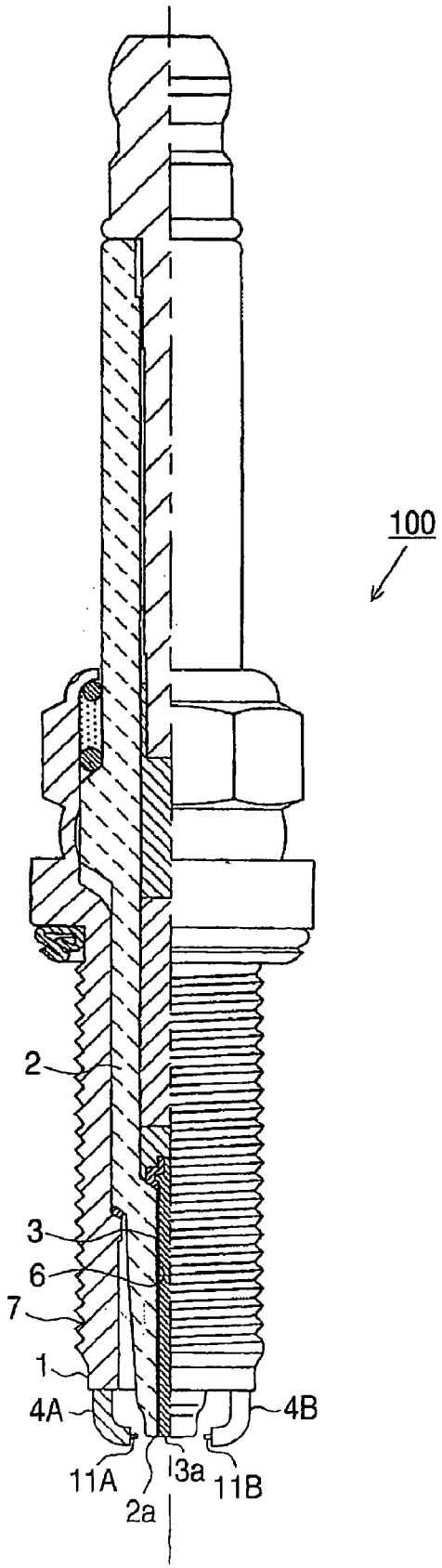
FIG. 1 is a partial break-away front view showing an overall configuration of a spark plug according to an embodiment of the invention.

Reference numerals used to identify various elements in the drawings include the following.

1: metal shell, 2: insulator, 3, 51, 52: center electrode, 4A, 4B, 41A, 41B, 42A, 42B, 43A, 43B, 44A, 44B, 45A, 45B, 46A, 46B: ground electrode, 11A, 11B, 31A, 31B, 32A, 32B, 33A, 33B, 34A, 34B: noble metal tip, 6: axial hole, 7: thread portion

DETAILED DESCRIPTION OF THE INVENTION

A preferred embodiment of the invention will now be described with reference to the drawings. However, the present invention should not be construed as being limited thereto.

Figure 2A:
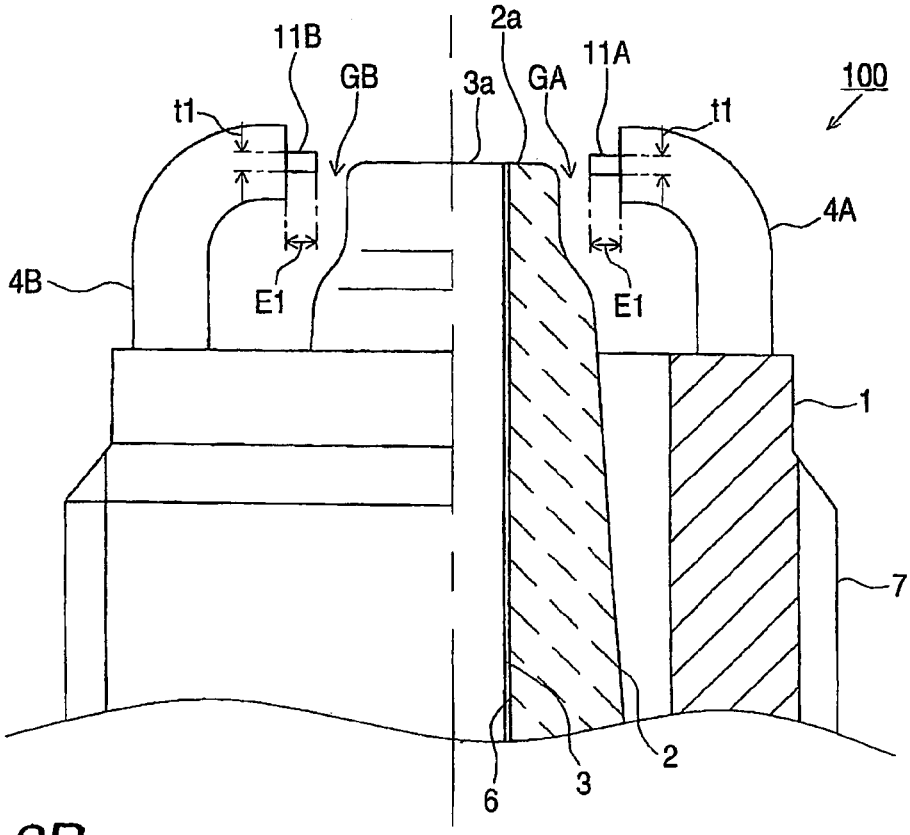
FIG. 2A is a partially break-away front view showing a configuration of major components of the spark plug of the invention.
Figure 2B:
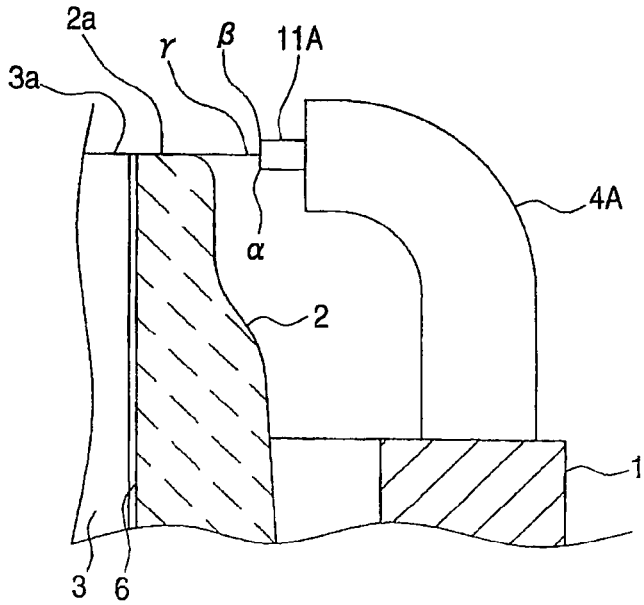
FIG. 2B is an enlarged view of the major components.
Figure 3:
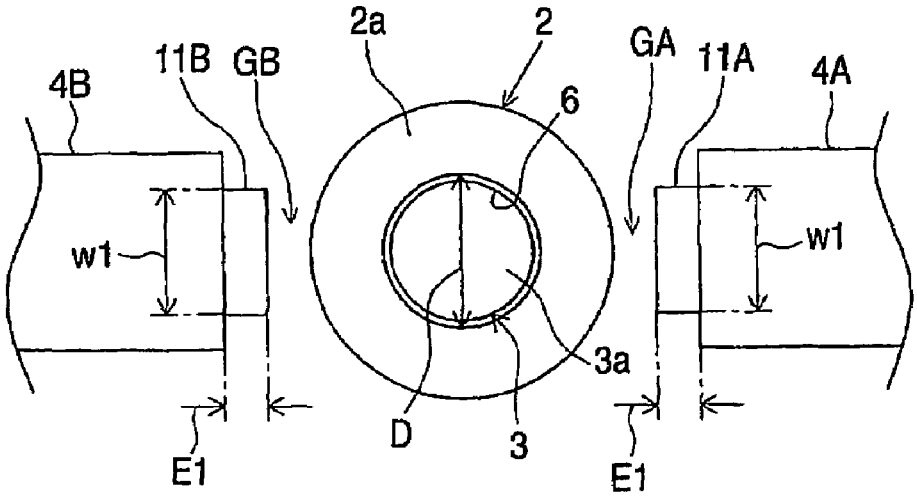
FIG. 3 is a plan view of the spark plug taken from a leading end side thereof.

FIG. 1 is an illustration showing an overall structure of a spark plug 100 of the present embodiment. FIGS. 2A and 2B are partial break-away front views showing major components of the spark plug. The following description will be made primarily with reference to FIGS. 2A and 2B. In FIGS. 2A, 2B, 4, 9A, 9B, 9C, 9D, 10A, 10B, 10C, 10D, 11A, 11B and 12, forward and rearward directions of an axis correspond to directions toward the top and bottom of the drawings, respectively. In FIG. 1, the forward (leading side) and rearward (base side) directions of the axis correspond to the directions toward the bottom and top of the drawing. FIGS. 3 and 8 are bird's eye views of the forward side of the plug, a direction across one side and the other side of the plane of the drawings corresponding to an axial direction.

As shown in FIGS. 2A and 2B, the spark plug 100 of the present embodiment includes a metal shell 1, an insulator 2, a center electrode 3, and two ground electrodes 4A and 4B. The metal shell 1 has a cylindrical shape and is formed from a metal such as low carbon steel. The metal shell constitutes the housing of the spark plug 100 and includes a thread portion 7 formed on an outer circumferential surface thereof for mounting the spark plug 100 on a cylinder head of an engine which is not shown. The insulator 2 is held inside the metal shell 1. A leading end surface 2*a* of the insulator 2 protrudes forwardly from a leading end surface of the metal shell 1.

The insulator 2 is constituted by a ceramic sintered body such as alumina. The insulator has an axial hole 6 extending through the insulator in an axial direction, and the center electrode 3 is inserted and secured in the axial hole 6 using known techniques of the related art. In the present embodiment, a leading end surface 3*a* of the center electrode 3 is substantially flush with the leading end surface 2*a* of the insulator 2.

Further, the ground electrodes 4A and 4B are provided in positions which are symmetrical about the center electrode 3, and a base end surface of each electrode is welded to the leading end surface of the metal shell 1. The ground electrodes 4A and 4B are bent at intermediate positions in the longitudinal direction thereof toward the leading side portion of the center electrode 3. The ground electrodes 4A and 4B are disposed such that their respective tip end surfaces face an outer circumferential surface of the leading end portion of the insulator 2. The ground electrodes 4A and 4B are made of a nickel alloy such as INCONEL 600 or 601®.

As shown in FIGS. 1 to 4, noble metal tips 11A and 11B protruding toward the leading end portion of the center electrode 3 are secured on the tip end surfaces of the ground electrodes 4A and 4B, and spark discharge gaps are formed between (second) protruding end surfaces of the noble metal tips 11A and 11*b* and an end portion of the center electrode 3. Spark discharge occurs at the spark discharge gaps when a sufficiently high, predetermined voltage (discharging voltage) is applied to the spark plug 100. A path of spark discharge is constituted by aerial discharge paths (gaps) formed between the (second) protruding end surfaces of the noble metal tips 11A and 11B and the insulator 2 (see gaps GA and GB in the figures) and surface-creeping discharge paths formed between the points on the insulator 2 constituting beginning points of the aerial discharge paths and the center electrode 3 so as to extend along the leading end surface 2*a* of the insulator 2.

The noble metal tips 11A and 11B of the present embodiment are made of a noble metal alloy, e.g., Pt-20Ni (atom %). The material composition is shown merely as an example, and the invention is not limited to the same in any sense. The noble metal tips 11A and 11B are welded and secured to the tip ends of respective ground electrodes 4A and 4B. At this time, the noble metal tips 11A and 11B may be welded and secured to the ground electrodes 4A and 4B so as to abut the respective ground electrodes. From the viewpoint of higher bonding rigidity, it is desirable, for example, to fit the tips into recesses formed on the tip end surfaces of the ground electrodes 4A and 4B in advance and to secure the tips by welding the boundaries between the ground electrodes 4A and 4B and the tips. Laser welding, electron beam welding or resistance welding may be used.

Figure 4:
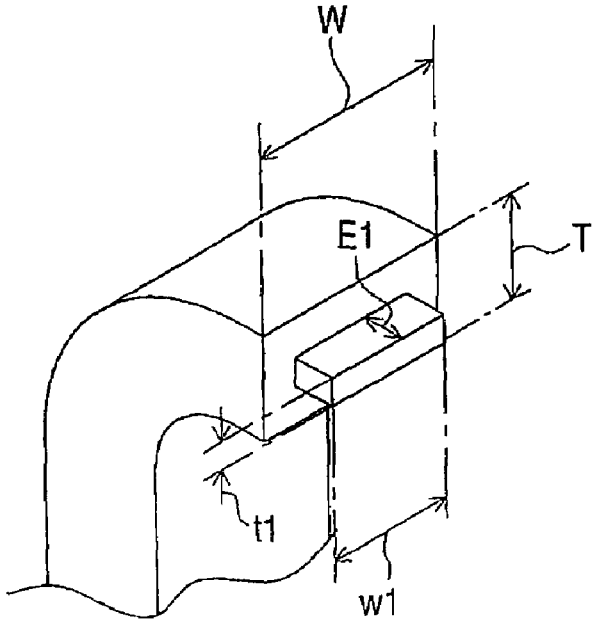
FIG. 4 is a perspective view showing a leading end portion of a ground electrode.

The ground electrodes 4A and 4B of the present embodiment have a rectangular sectional shape having a width W of 2.8 mm and a thickness T of 1.5 mm (see FIG. 4). The noble metal tips 11A and 11B have a protrusion length E1 which is longer than 0.2 mm and is not longer than 5 mm (e.g., 0.6 mm in the present embodiment) from the leading end surfaces of the ground electrodes 4A and 4B.

The noble metal tips 11A and 11B have a rectangular parallelepiped shape (sheet-like shape), and they are disposed so as to extend orthogonally to the axial direction and in the radial direction toward the center electrode 3. The metal tips have a thickness t1 (a length in the axial direction) in the range between 0.2 mm and 1.0 mm, inclusive (e.g., 0.4 mm in the present embodiment). Further, the noble metal tips 11A and 11B have a width w1 which is not smaller than 50% of a diameter D of the axial hole at the leading end surface 2*a* of the insulator 2 and not greater than the outer diameter of the leading end surface 2*a* of the insulator 2 (e.g., 90% of the diameter D in the present embodiment) (see FIG. 3).

When the spark plug 100 is frontally viewed (see FIGS. 2A and 2B), the noble metal tips 11A and 11B are formed such that base-side edges a of the end surfaces of the noble metal tips 11A and 11B, which are base-side extremities of the end surfaces in the axial direction, are displaced toward the base-side from an imaginary plane γ including the leading end surface 2*a* of the insulator 2 and such that end-side edges β of the protruding surfaces of the noble metal tips 11A and 11B, which are leading-side extremities of the end surfaces in the axial direction, are displaced toward a leading side from the imaginary plane. That is, the imaginary plane γ including the leading end surface 2*a* of the insulator 2 is located between the base-side edges α and the leading-side edges β (see FIG. 2B).

As described above, in the present embodiment, since the noble metal tips 11A and 11B protruding toward an end portion of the center electrode 3 are secured on the tip end surfaces of the ground electrodes 4A and 4B, spark discharge occurs between the noble metal tips 11A and 11B and the center electrode 3. Since the noble metal electrodes 11A and 11B have a high oxidation resistance at high temperatures and high wear resistance, the metal tips themselves and the ground electrodes 4A and 4B are subjected to less wear, and sufficient durability is achieved. Since the spark discharge path includes the surface-creeping discharge paths extending along the leading end surface 2*a* of the insulator 2 as a part of the same, spark discharge occurs so as to creep over the leading end surface 2*a*. Thus, fouling substances deposited on the surface of the insulator 2 as a result of smoldering or fouling are burned off, and sufficient anti-fouling properties can be achieved. In particular, since the width w1 of the noble metal tips 11A and 11B is 50% or more (e.g., 90% in the present embodiment) of the axial hole diameter D at the leading end surface 2*a* of the insulator 2, sparks fly toward the center electrode 3 in a wider range, which makes it possible to burn off fouling substances on the leading end surface 2*a* of the insulator 2 around the center electrode 3 with high reliability. Consequently, anti-fouling properties can be further improved.

The ground electrodes 4A and 4B can be provided with sufficient durability without substantially increasing their size. Since the electrode size is thus kept small, obstruction of the space accommodating spread of the flame kernel and removal of heat from the flame will be suppressed accordingly. It is therefore possible to suppress reduction in ignition capability. Particularly, in the present embodiment, the protruding length E1 of the noble metal tips 11A and 11B from the leading end surfaces of the ground electrodes 4A and 4B is longer than 0.2 mm, and the thickness t1 of the metal tips is 1.0 mm or less. It is therefore easier to accommodate a sufficient space for combustion, and a further improvement in ignition capability consequently can be achieved.

Referring to the region where spark discharge can take place, the total area of the surfaces of the protruding ends of the noble metal tips 11A and 11*b* having a small sectional area and the surface of a leading portion of the insulator 2 facing the same can be made smaller than the total area of the surfaces of the tip end of the ground electrodes having no such noble metal tips and the surface of the leading portion of an insulator facing the same. It is therefore possible to reduce opportunities in which insufficiently atomized fuel collects between a leading portion of the insulator 2 and the noble metal tips 11A and 11B. As a result, the occurrence of fuel bridging can be suppressed.

In addition, since the noble metal tips 11A and 11B are configured to protrude from the ground electrodes 4A and 4B, the length of the electrodes can be kept small accordingly. Therefore, the ground electrodes 4A and 4B have a small heat-receiving area, and the thermal load to the respective electrodes can be suppressed. Furthermore, since the weight of the ground electrodes 4A and 4B can be made small, vibration can be suppressed to provide the electrodes with improved breakage resistance.

The imaginary plane γ including the leading end surface 2*a* of the insulator 2 is located between the base-side edges α and the leading-side edges β of the protruding end surfaces of the noble metal tips when viewed in the axial direction. That is, the protruding end surfaces of the noble metal tips 11A and 11B and the leading end surface 2*a* of the insulator 2 are located substantially at the same height. Since the thickness of the noble metal tips 11A and 11B is as small as 1.0 mm or less as described above, aerial discharge between the end surfaces of the noble metal tips 11A and 11B and the insulator 2 begins in the vicinity of the leading end surface 2*a* of the insulator 2. It is desirable to set the beginning points of aerial discharge or surface discharge closer to the base than to the leading end surface 2*a* in order to improve resistance to fouling attributable to surface discharge (cleanness). However, the configuration of the present embodiment makes it possible to suppress or reduce channeling while improving anti-fouling properties.

In order to conform the operation and effects of the present embodiment, various samples were fabricated and evaluated. The experimental results are described below.

Figure 5:
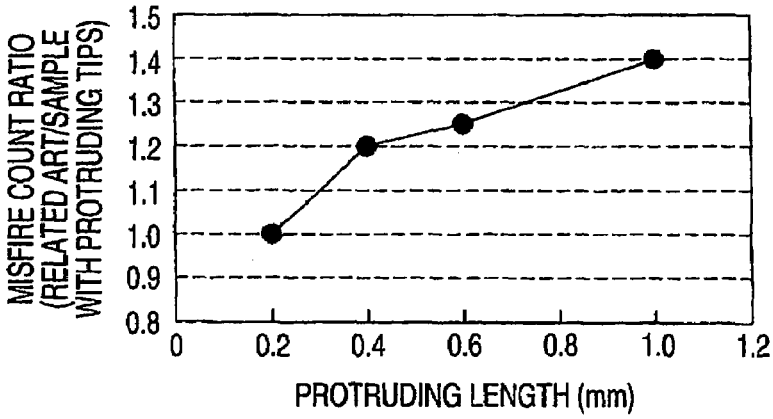
FIG. 5 is a graph showing the relationship between the protruding length of the noble metal tip and misfire count ratio.

First, samples (spark plugs) having substantially the same shape as that of the spark plug 100 in FIGS. 1, 2A, and 2B were prepared with only the noble metal tips varied to have different protruding lengths, i.e., 0.2 mm, 0.4 mm, 0.6 mm, 0.8 mm, and 1.0 mm. The number of misfires was measured for each sample, and the ratio of the number of misfires to that of a product according to the related art (which had no tip or a protruding length of 0 mm) was measured. Referring to dimensions other than the protruding length, the noble metal tips had a width of 1.5 mm and a thickness of 0.8 mm. Referring to the measurement of the number of misfires, each sample (spark plug) to be evaluated and tested was mounted to a DOHC straight six-cylinder engine having a displacement of 2000 cc, and the number of misfires during a predetermined time was measured with the engine rotated at 2000 rpm using a predetermined lean air-fuel mixture. FIG. 5 shows the calculated misfire count ratios between the samples having protruding tips and the product according to the related art.

As shown in FIG. 5, a tip protruding length of 0.2 mm resulted in a misfire count similar to that of the related art, and it was observed that protruding lengths exceeding 0.2 mm tended to result in lower misfire counts than that of the related art. It can be concluded from such findings that a sufficient space for combustion can be more easily accommodated to improve ignition capability when the protruding length of the noble metal tips exceeds 0.2 mm.

Figure 6:
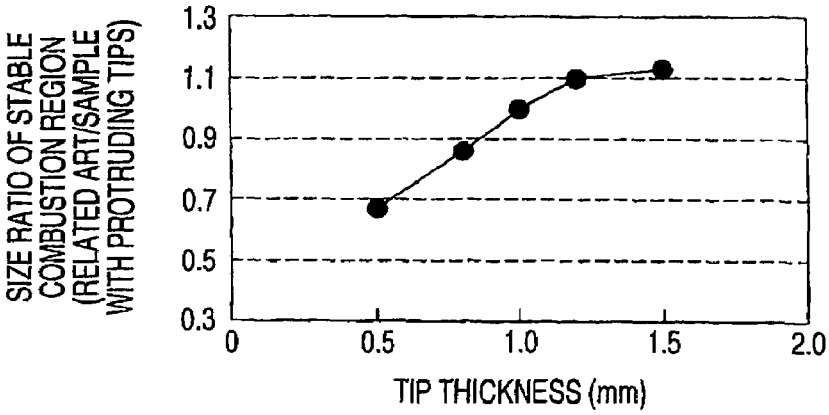
FIG. 6 is a graph showing the relationship between noble metal tip thickness and size ratio of a stable combustion region.

Next, samples (spark plugs) with noble metal tips having different thicknesses, i.e., 0.5 mm, 0.8 mm, 1.0 mm, 1.2 mm. and 1.5 mm were prepared. A stable combustion region of each sample was measured, and the ratio between the same region and a stable combustion region of the product according to the related art (having no tip) was measured. Referring to dimensions other than thickness, the tips had a width of 1.5 mm and a protruding length of 0.4 mm. Referring to measurement of the stable combustion region, each sample (spark plug) to be evaluated and tested was mounted to a DOHC straight four-cylinder direct injection type engine having a displacement of 1800 cc, and a region having no misfire was measured as an area while rotating the engine at 3000 rpm and varying the ignition timing and fuel injection timing. The region (area) having no misfire was calculated as follows. Spark discharge was caused with the ignition timing and the air-fuel ratio varied, and proper ignition events were plotted on a graph whose abscissa axis represents the ignition timing and whose ordinate axis represents the fuel injection timing. By repeating this process, a boundary can be found between ignition events and misfire events. What is measured is the area enclosed by the boundary thus found. More particularly, a matrix in which the abscissa axis represents ignition timing and the ordinate axis represents the air-fuel ratio is firstly formed. Then, the matrix fields are filled upon evaluating whether or not proper ignition has occurred under the specified conditions of the respective matrix fields By mapping the misfire regions and ignition regions included in the matrix, an area representing a stable combustion region (the area of the ignition regions) can be determined. FIG. 6 shows the calculation results of the ratios between the size of the stable combustion regions of the samples having protruding tips and the product according to the related art.

As shown in FIG. 6, it was observed that a stable combustion region wider than that of the related art can be obtained when the tip thickness is 1.0 mm or less. It can be concluded from the above that a sufficient space for combustion can be easily provided to improve ignition capability by keeping the tip thickness at 1.0 mm or less. Further, since combustion is maintained even under conditions which are likely to cause smoldering, an improvement in anti-fouling properties can be also achieved.

Figure 7:
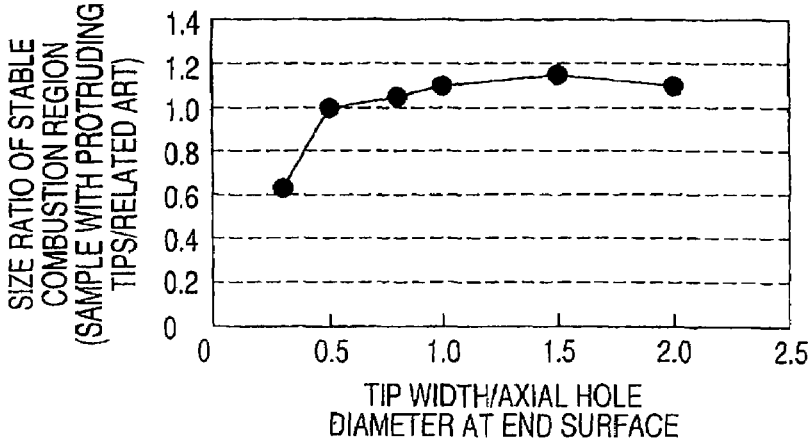
FIG. 7 is a graph showing the relationship between noble metal tip width and size ratio of a stable combustion region.

Next, samples (spark plugs) having different noble metal tip widths, i.e., widths equivalent to 30%, 50%, 80%, 100%, 150% and 200% of the axial hole diameter at the leading end surface of the insulator, were prepared. A stable combustion region of each sample was measured, and the ratio between the same region and a stable combustion region of the product according to the related art (having no tip) was measured. Referring to dimensions other than the widths, the tips had a thickness of 0.8 mm and a protruding length of 0.4 mm. Referring to the measurement of the stable combustion region, each sample (spark plug) to be evaluated and tested was mounted to a DOHC straight four-cylinder direct injection type engine having a displacement of 1800 cc, and a region (area) having no misfire was measured while rotating the engine at 3000 rpm and varying the ignition timing and fuel injection timing. The method of calculating the region is similar to the above-described method of calculating a stable combustion region associated with tip thickness. FIG. 7 shows the calculation results of the ratio between the stable combustion region (area) of respective samples having a protruding tip and the product according to the related art. The abscissa axis of the graph in FIG. 7 represents the ratio of tip width to the axial hole diameter at the leading end surface of the insulator.

As shown in FIG. 7, a stable combustion region having a size similar to that of the related art was obtained when the ratio of the tip width to the axial hole diameter at the leading end surface of the insulator was 50%, whereas it was observed that stable combustion regions wider than that of the related art can be obtained by tip width ratios of more than 50%. It can be concluded from the above that a further improvement in anti-fouling properties can be achieved by setting the ratio of the tip width to the axial hole diameter at the leading end surface of the insulator at 50% or more, more particularly, more than 50%.

The invention is not limited to the above-described embodiment, and may be carried out in various modes as follows.

Figure 8A:
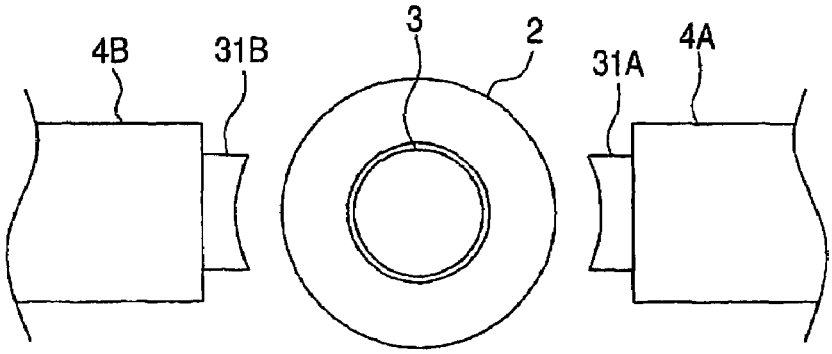
FIGS. 8A to 8C are schematic plan views of center electrodes and ground electrodes in other embodiments of the invention.

(a) While the above-described embodiment employs the noble metal tips 11A and 11B whose protruding end surfaces are flat surfaces, for example, it is possible to employ noble metal tips 31A and 31B having a protruding end surface which is a curved surface in the form of a recess extending along an outer circumferential surface of the insulator 2 (center electrode 3) as shown in FIG. 8A. In this case, an average value of the protrusion lengths at side parts and central parts in the width direction of the protrusions is preferably used as the protruding length of the noble metal tips 31A and 31B from the leading ends of the ground electrodes 4A and 4B, and the average value preferably exceeds 0.2 mm.

Figure 8B:
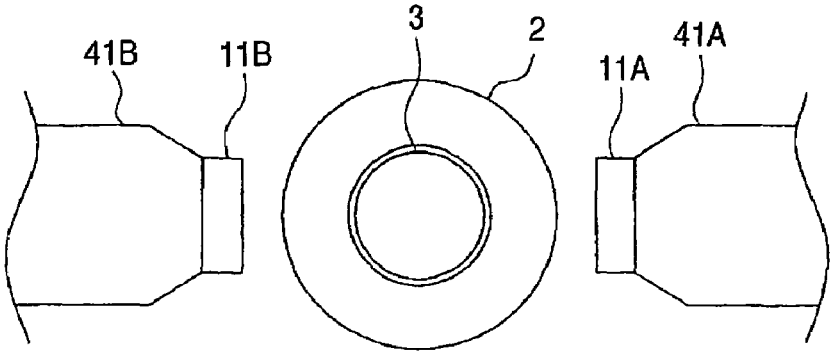

While the above described embodiment employs the ground electrodes 4A and 4B whose sectional shape does not change in the longitudinal direction thereof, ground electrodes 41A and 41B tapered to have a smaller width at protruding ends thereof may alternatively be used as shown in FIG. 8B. Such a configuration makes it easier to provide sufficient space for combustion and allows further improvement in ignition capability.

Figure 8C:
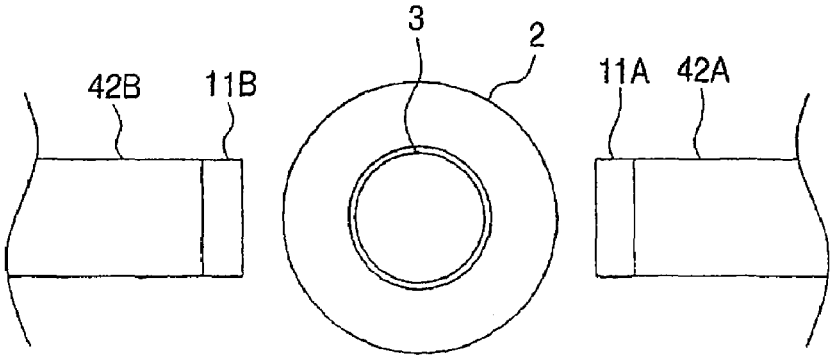

Further, the ground electrodes 4A and 4B of the above-described embodiment have a width W greater than the width w1 of the noble metal tips 11A and 11B. As shown in FIG. 8C, when ground electrodes 42A and 42B having a smaller width are used, they may have the same width as the noble metal tips 11A and 11B. Such an arrangement does not create any problem. In this case, however, the noble metal tips 11A and 11B are still required to have a thickness smaller than the thickness of the ground electrodes 42A and 42B.

Figure 9A:
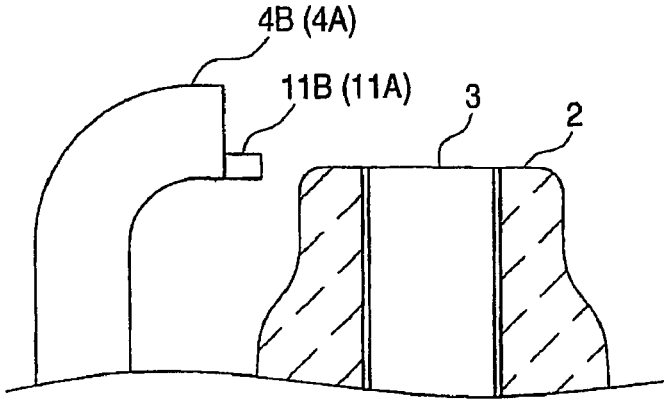
FIGS. 9A to 9D are partial break-away front views of center electrodes and ground electrodes in other embodiments of the invention.
Figure 9B:
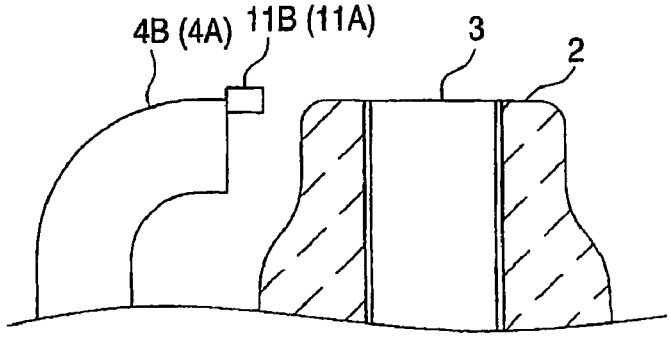

(b) The above-described embodiment is a specific instance in which the noble metal tips 11A and 11B protrude from central parts of the tip end surfaces of the ground electrodes 4A and 4B when viewed in the axial direction. For example, as shown in FIG. 9A, the noble metal tips 11A and 11B may alternatively protrude from a base-side part of the tip end of the ground electrodes 4A and 4B when viewed in the axial direction. Alternatively, the noble metal tips 11A and 11B may protrude from a leading-side part of the tip end surface of the ground electrodes 4A and 4B when viewed in the axial direction as shown in FIG. 9B.

Figure 9C:
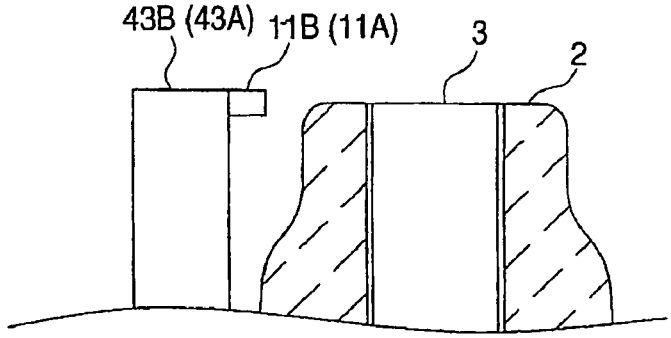

(c) The above-described embodiment is a specific instance in which the distal ends of the ground electrodes 4A and 4B are bent toward an end portion of the center electrode 3 in an intermediate position in the longitudinal direction thereof. For example, as shown in FIG. 9C, ground electrodes 43A and 43B in the form of straight rods extending in the axial direction (having no bent part) may alternatively be used. In this case, the noble metal tips 11A and 11B protrude from inner side surfaces of the distal ends of the ground electrodes 43A and 43B.

Figure 9D:
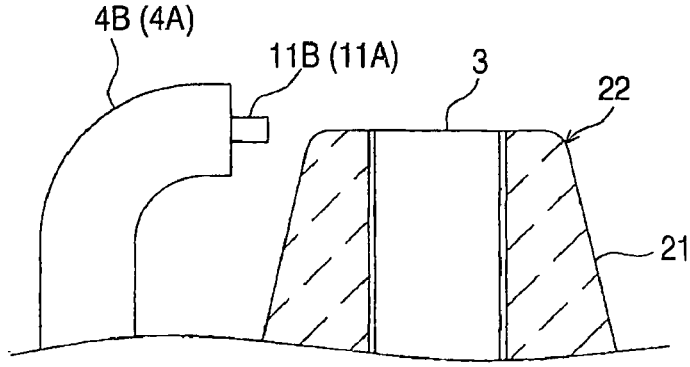

(d) The shape of the insulator 2 is not necessarily limited to that described in the above embodiment. For example, as shown in FIG. 9D, an insulator 22 having a tapered surface 21 which becomes thinner toward the leading end thereof may alternatively be used.

Figure 10A:
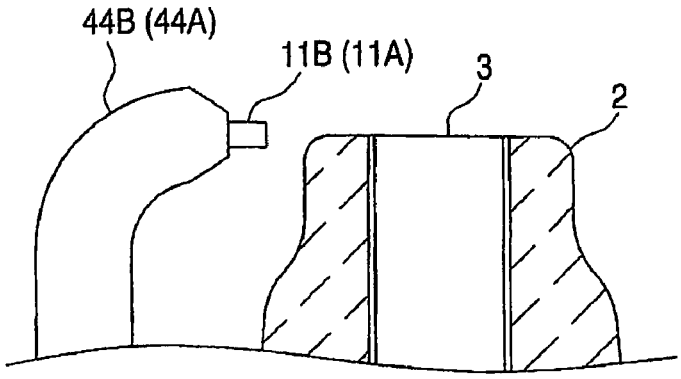
FIGS. 10A to 10D are partial break-away front views of center electrodes and ground electrodes in other embodiments of the invention.

(e) Although the ground electrodes 41A and 41B tapered toward a smaller width at protruding ends thereof are shown by way of example in FIG. 8B, ground electrodes 44A and 44B which are tapered in the width direction (which become smaller in thickness toward the protruding ends) may alternatively be used as shown in FIG. 10A. Such a configuration allows sufficient space for combustion and also allows a further improvement in ignition capability.

Figure 10B:
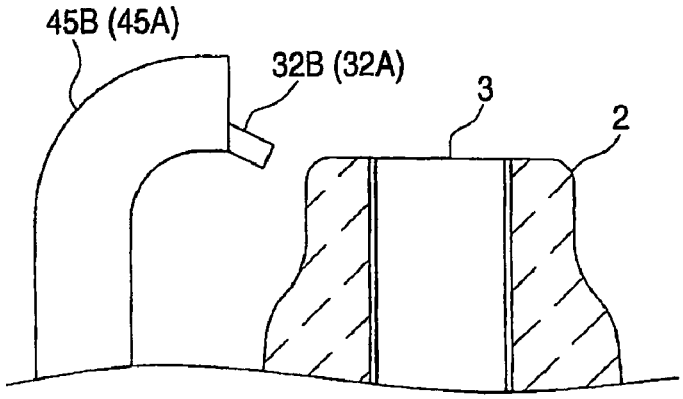
Figure 10C:
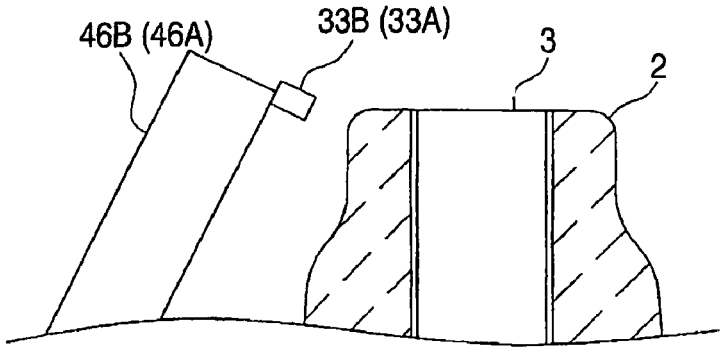
Figure 10D:
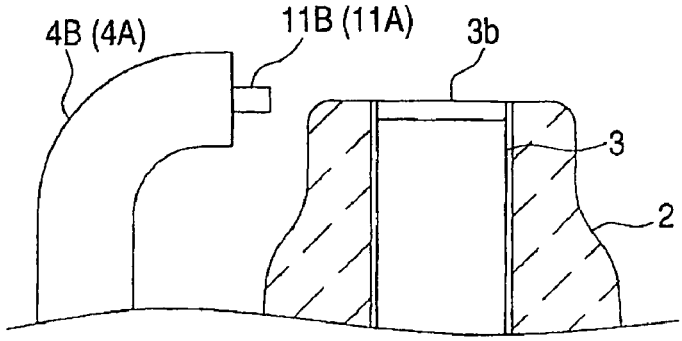

(f) Although the above-described embodiment employs the noble metal tips 11A and 11B protruding in parallel with the leading end surface 2*a* of the insulator 2, it is not essential to achieve such parallelism. For example, as shown in FIG. 10B, ground electrodes 45A and 45B extending in a greater amount toward the leading side of the plug, and noble metal tips 32A and 32B obliquely protruding from the tip end surfaces of the electrodes may be used. In this case again, sufficient space for combustion can be more easily provided, and a further improvement in ignition capability can be achieved. As shown in FIG. 10C, tilted ground electrodes 46A and 46B may be used, and noble metal tips 33A and 33B obliquely protruding from an inner side surface of the electrodes may be used. Further, a noble metal part 3*b* may be provided on top of the center electrode 3 as shown in FIG. 10D.

The configuration shown in FIG. 10C in which the ground electrodes are formed as straight rods without bending is advantageous especially in manufacturing a spark plug having a diameter as small as M10 or less. As described above, the smaller the diameter of the spark plug, the more difficult it becomes to bend the ground electrodes so that the distal ends thereof are directed toward a center electrode. In this regard, the configuration shown in FIG. 10C makes it possible to eliminate such a difficulty encountered in manufacturing.

Figure 11A:
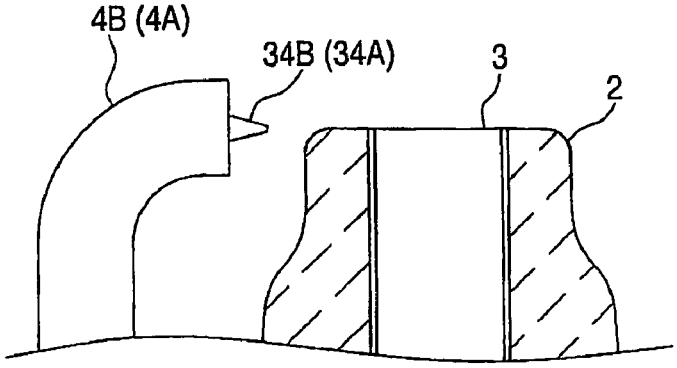
FIGS. 11A and 11B are partial break-away front views of center electrodes and ground electrodes in other embodiments of the invention.

(g) The noble metal tips 11A and 11B in the form of a rectangular parallelepiped have been described by way of example in the above embodiment. For example, as shown in FIG. 11A, noble metal tips 34A and 34B decreasing in thickness toward protruding ends thereof may alternatively be used.

Figure 11B:
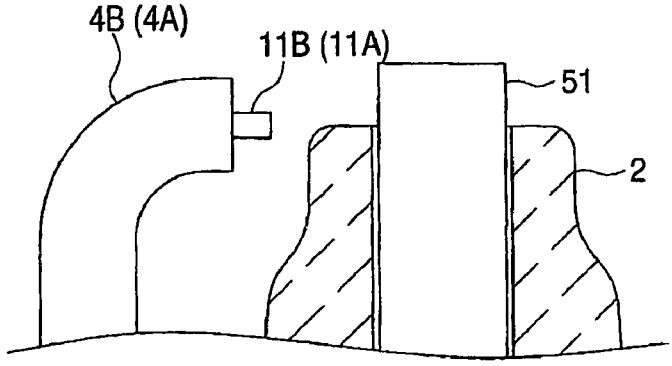

(h) In the above-described embodiment, the end surface 3*a* of the center electrode 3 is substantially flush with the leading end surface 2*a* of the insulator 2. Alternatively, as shown in FIG. 11B, a center electrode 51 having an end surface protruding beyond the leading end surface 2*a* of the insulator 2 may be used. Conversely, the end surface of the center electrode may be set back from the leading end surface of the insulator toward the base-side.

Figure 12:
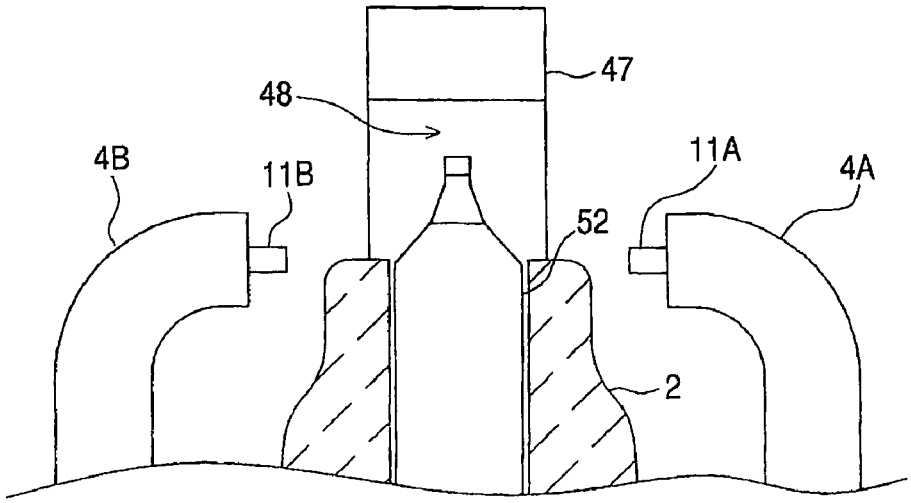
FIG. 12 is a partial break-away front view of a center electrode and ground electrodes in another embodiment of the invention.

(i) The above-described embodiment has a configuration in which the two ground electrodes 4A and 4B are provided in positions symmetrical about the center electrode 3. Alternatively, three or more ground electrodes may be provided. In addition to the ground electrodes 4A and 4B capable of surface discharge, as shown in FIG. 12, a parallel ground electrode 47 may be provided, which faces the leading end surface of the center electrode at one side surface thereof and which forms an aerial discharge gap extending in the axial direction. In this case, a spark discharge gap 48 is formed between the side surface on the distal end of the parallel ground electrode 47 and an end surface of the center electrode 52.

As mentioned in item (f) above, a metal shell 1 having a thread portion 7 with a thread diameter of M10 or less may be used in an active manner.

In forming a semi-surface discharge type spark plug, when the thread diameter of the outer periphery of the metal shell is made as small as M10 or less, practical difficulties are encountered in the related art in bending the leading ends of the ground electrodes along the end surface of the insulator for reasons associated with space. On the contrary, when a configuration involving the noble metal tips 11A and 11B protruding as described in the present embodiment is used, semi-surface discharge can be realized without difficulty even if the thread diameter of the outer periphery of the metal shell 1 is as relatively small as M10 or less.

(k) In the above-described embodiment, the ground electrodes 4A and 4B are made of a nickel alloy such as INCONEL 600 or 601®. Alternatively, ground electrodes having a double layer structure including inner and outer layers may be employed. In this case, for example, the outer layer may be made of a nickel alloy as described above, and the inner layer may be made of a metal having a thermal conductivity higher than that of the nickel alloy (e.g., a metal material primarily composed of copper or high purity nickel having a thermal conductivity higher than that of the nickel alloy). The center electrode 3 may also have a double layer structure including outer and inner layers.

(l) Although not mentioned in the above-described embodiment, a side surface at an end of the insulator 2 continues to the leading end surface 2*a* of the same so as to define a predetermined radius of curvature R (the leading end portion of the insulator 2 has a curved surface), in general. It is desirable that the radius of curvature R and the thickness t1 of the noble metal tips 11A and 11B satisfy a relationship expressed by:

$$R \geqq 0.2 \text{ mm}$$

$$t1(\text{mm}) \times R(\text{mm}) \leqq 1$$

The position of spark discharge may vary when the radius of curvature R is too large, and the position of spark discharge tends to vary similarly when the tip thickness t1 is too large. Therefore, in order to advantageously achieve the effects of the invention, it is more preferable to set the radius of curvature R and the tip thickness t1 such that the above relationship is satisfied.

It should further be apparent to those skilled in the art that various changes in form and detail of the invention as shown and described above may be made. It is intended that such changes be included within the spirit and scope of the claims appended hereto.

This application is based on Japanese Patent application JP 2006-91468, filed Mar. 29, 2006, the entire content of which is hereby incorporated by reference, the same as if set forth at length.

What is claimed is:

1. A spark plug having a leading side and a base side, said spark plug comprising:

a cylindrical insulator having an axial hole extending through the insulator in an axial direction;

a center electrode inserted in the axial hole;

a metal shell provided around an outer periphery of the insulator and having a leading end surface, from which a leading end surface of the insulator protrudes;

one or more ground electrodes having a base end bonded to the leading end surface of the metal shell; and a noble metal tip having a first end disposed on a distal tip end surface of the one or more ground electrodes, a second end of the noble metal tip protruding toward the center electrode in a radial direction, and the second end of the noble metal tip facing at least a part of the end of the insulator, wherein:

said spark plug forming a spark discharge path upon application of a discharging voltage between the second end of the noble metal tip and an end of the center electrode, said spark discharge path comprising an aerial discharge gap between a part of the second end of the noble metal tip and a part of the end of the insulator and a surface-creeping discharge path beginning at a part of the end of the insulator and a part of the center electrode and extending along the end surface of the insulator; and said noble metal tip protruding from the distal end of the ground electrode by a protruding length of more than 0.2 mm.

2. The spark plug according to claim 1, wherein the protruding length of the noble metal tip from the distal end of the ground electrode is 5 mm or less.

3. The spark plug according to claim 1, wherein the noble metal tip has a thickness of 1.0 mm or less.

4. The spark plug according to claim 3, wherein the noble metal tip has a thickness of 0.2 mm or more.

5. The spark plug according to claim 1, wherein the noble metal tip has a width which is 50% or more of a diameter of the axial hole at an end surface of the insulator.

6. The spark plug according to claim 5, wherein the noble metal tip has a width equal to or smaller than an outer diameter of an end surface of the insulator.

7. The spark plug according to claim 1, wherein an end-side edge of the second end surface of the noble metal tip, when viewed in the axial direction, is displaced from an end surface of the insulator toward the leading side of the spark plug, and wherein an opposing end-side edge of the second end surface of the noble metal tip, when viewed in the axial direction, is displaced from the end surface of the insulator toward the base side of the spark plug.

8. The spark plug according to claim 1, comprising a plurality of ground electrodes having disposed thereon the noble metal tip of claim 1.

9. The spark plug according to claim 1, further comprising a parallel ground electrode facing an end surface of the center electrode at one side surface thereof and forming an aerial discharge gap extending in the axial direction.

10. The spark plug according to claim 1, wherein the outer periphery of the metal shell has a thread having a diameter of M10 or less.

11. The spark plug according to claim 1, wherein a side surface of the insulator continues to an end surface of the insulator so as to define a radius of curvature R≧0.2 mm, which radius of curvature R and a thickness t1 of the noble metal tip satisfy a relationship expressed by:

$$t1(\mathrm{mm})\times R(\mathrm{mm})\leqq 1.$$

12. The spark plug according to claim 1, wherein the noble metal tip has a shape in the form of a sheet.

* * * * *